US006013919A

United States Patent [19]

Schneider et al.

[11] Patent Number: 6,013,919

[45] Date of Patent: Jan. 11, 2000

[54] FLAME SENSOR WITH DYNAMIC SENSITIVITY ADJUSTMENT

[75] Inventors: Donald A. Schneider, Lakewood; Leo Lombardo, Lyndhurst, both of Ohio

[73] Assignee: General Electric Company, Schenectady, N.Y.

[21] Appl. No.: 09/041,642

[22] Filed: Mar. 13, 1998

[51] Int. Cl.[7] ..... G01J 3/14

[52] U.S. Cl. ..... 250/554; 340/577

[58] Field of Search ..... 250/554, 221, 250/206, 214 R, 214.1, 339.15; 340/555, 557, 577, 578; 431/79; 73/116

[56] References Cited

U.S. PATENT DOCUMENTS

| | | | |
|---|---|---|---|
| 5,257,496 | 11/1993 | Brown et al. | 60/39.06 |
| 5,303,684 | 4/1994 | Brown et al. | 123/435 |
| 5,394,005 | 2/1995 | Brown et al. | 257/461 |
| 5,467,185 | 11/1995 | Engeler et al. | 356/44 |
| 5,480,298 | 1/1996 | Brown | 431/79 |
| 5,487,266 | 1/1996 | Brown | 60/39.06 |
| 5,589,682 | 12/1996 | Brown et al. | 250/554 |
| 5,670,784 | 9/1997 | Cusack et al. | 250/372 |

*Primary Examiner*—Que T. Le
*Attorney, Agent, or Firm*—Nixon & Vanderhye P.C.

[57] ABSTRACT

The present invention provides a flame sensor having dynamic sensitivity adjustment, wherein the sensitivity of the flame detector can be adjusted by varying the gain of a signal conditioning circuit associated with the flame detector. The flame detector includes a photodiode, such as, for example, a silicon carbide (SiC) photodiode, that, when exposed to electromagnetic radiation having a wavelength in the range of from about 190–400 nanometers, and preferably within the ultraviolet range. The photodiode generates a photocurrent proportional to the ultraviolet light intensity to which it is exposed. The output of the photodiode is processed and amplified by signal conditioning circuitry to produce a signal indicative of the presence of a flame. Moreover, a cutoff wavelength for silicon carbide photodiodes is preferably in the range of about 400 nanometers, which renders the photodiode "blind" to potentially interfering blackbody radiation from the walls of the turbine.

9 Claims, 3 Drawing Sheets

FLAME SENSOR WITH DYNAMIC SENSITIVITY ADJUSTMENT

BACKGROUND OF THE INVENTION

1. Field of the Invention

The invention relates generally to an optical sensor arrangement for detecting the presence of a flame in a gas turbine engine. In particular, the invention is directed to a photodiode flame sensor having a variable sensitivity and simplified signal conditioning circuitry.

2. Related Art

A standard method for detecting the presence of a flame in a gas turbine engine has been to use a light activated or photosensitive tube, such as, for example, a Geiger-Mueller gas discharge tube. Such tube-based detectors typically include a phototube having a cathode that is phototransmissive, and an anode for collecting the electrons emitted by the cathode. The tubes are filled with a gas at low pressure that is ionized by any accelerated electrons. A large voltage potential, for example, 200–300 volts, is typically applied to, and maintained between, the cathode and anode, such that in the presence of a flame or light emitting a wavelength to which the tube is sensitive, photons of a given energy level will illuminate the cathode and cause electrons to be released and accelerated, thereby ionizing the gas.

Geiger-Mueller gas discharge tubes have a peak spectral response at approximately 200 nanometers. Emissions at this wavelength cause the gas in the tube to ionize as discussed above, causing a momentary pulse of current in the power supply. The frequency of these pulses is proportional to the ultraviolet intensity at low light levels. At higher levels, the output saturates at a frequency determined by the quenching time of the gas.

With the advent of low emission gas turbines, tubes have proven to be somewhat unreliable. The low emission turbines implement several methods to reduce emissions, including steam injection, water injection and pre-mixed fuels. All of these emission reducing methods tend to absorb ultraviolet radiation, thereby reducing the signal to the tube. Moreover, the Geiger-Mueller tube is a low frequency device that requires a long integration time, e.g., 125 milliseconds, before a decision as to flame status can be made.

Another system for flame detection, specifically for detecting the presence of afterburner flame in augmented gas turbine engines is disclosed in U.S. Pat. No. 4,510,794 to Couch. The Couch system relies on an ion/electrostatic probe that provides ionic flame detection and electrostatic engine wear monitoring by measuring the conductivity through the plasma of the afterburner flame.

Recently, modern electronic systems have replaced archaic tube-based hardware with semiconductor components, such as, for example, photodiodes. Photodiodes have been used in applications for measuring or detecting the presence of light throughout the visible spectrum and the ultraviolet spectrum. Their smaller size, greater stability, enhanced reliability and lower cost make them vastly superior to phototubes, such as, for example, Geiger-Mueller gas discharge tubes.

Generally, a photodiode is a p-n junction with an associated depletion region in which an electric field separates photogenerated electron-hole pairs, the movement of which generates a measurable current. When electromagnetic radiation of an appropriate magnitude strikes the semiconductor material of the photodiode, the electron-hole pairs are generated by photoconductive action. When these charge carriers are generated near a p-n junction, the electric field of the depletion region at the junction separates the electrons from the holes in the normal p-n junction fashion. This separation produces a short circuit current or open circuit voltage, typically referred to as the photovoltaic effect. Such photodiodes are of the type disclosed in U.S. Pat. No. 5,093,576 to Edmond et al.

U.S. Pat. Nos. 5,303,684 and 5,257,496 both to Brown et al. and commonly assigned to the assignee of the instant application, the disclosures of which are incorporated by reference in their entireties herein, disclose a combustion control system for controlling the level of $NO_x$ emissions produced in the combustion process to reduce such emissions, while maintaining a sufficiently high combustion flame temperature. This is achieved by monitoring the intensity of non-infrared spectral lines associated with the combustion flame and then dynamically adjusting the fuel/air ratio of the fuel mixture. These patents describe, in a general sense, the use of silicon carbide (SiC) photodiodes to measure light intensity in a system for generating a signal corresponding to the $NO_x$ emission concentration for adjusting the engine operation parameters.

U.S. Pat. No. 5,670,784 to Cusack et al. discloses a high temperature gas stream optical flame sensor for flame detection in gas turbine engines. The sensor includes a silicon carbide photodiode and silicon carbide based amplification hardware for generating a signal indicative of the presence of a flame. The photodiode and amplifier hardware are preferably disposed in a sensor housing. However, there is no disclosure in Cusack et al. of any means for adjusting the sensitivity of the photodiode detection circuit. Additionally, the processing circuitry associated with the disclosed sensor arrangement is unnecessarily complex.

SUMMARY OF THE INVENTION

The present invention provides an improved flame sensor system that overcomes deficiencies of known flame detection systems. The present invention provides a flame sensor having dynamic sensitivity adjustment, wherein the sensitivity of the flame detector can be adjusted by varying the gain of a signal conditioning circuit associated with the flame detector.

The flame detector includes a photodiode, such as, for example, a silicon carbide (SiC) photodiode, that, when exposed to electromagnetic radiation having a wavelength in the range of from about 190–400 nanometers, and preferably within the ultraviolet range. The photodiode generates a photocurrent proportional to the ultraviolet light intensity to which it is exposed. The output of the photodiode is processed and amplified by signal conditioning circuitry to produce a signal indicative of the presence of a flame. Moreover, a cutoff wavelength for silicon carbide photodiodes is preferably in the range of about 400 nanometers, which renders the photodiode "blind" to potentially interfering blackbody radiation from the walls of the turbine.

Additionally, the flame detector of the present invention has increased ultraviolet sensitivity to enable it to detect the presence of flame through, for example, a mist of steam, water or pre-mixed fuel, and to eliminate the need for high operating voltages. Because silicon carbide photodiodes do not require a high voltage to operate, the invention provides a flame detector that is capable of operating as a current transmitter and of operating from dc power supplies operating in the range of, for example, 12–30 volts.

Yet another feature of the present invention is a significant reduction in response time of the detector, which avoids unnecessary turbine shutdowns during mode changes, and the like. The response time of the flame detector is determined by the capacitance of the photodiode and the feedback resistance of the input amplifier. Accordingly, the value of the discrete components of the flame detector and the signal conditioning circuitry associated therewith, are selected to produce response times in the range of about 25 milliseconds.

These and other objects and their attendant advantages, are achieved by the present invention, which provides an improved flame detector, including: a photosensitive diode, such as, for example, a silicon carbide photodiode, responsive to exposure to a flame to generate a photocurrent proportional to the intensity of ultraviolet radiation of the flame; and signal conditioning circuitry connected to the silicon carbide photodiode, the signal conditioning circuitry including a gain stage having an associated feedback loop, wherein a sensitivity of the flame detector is adjusted by varying the gain of the gain stage. In addition, the signal conditioning circuitry includes amplification circuitry that amplifies the photocurrent and converts it to an industry standard current output in the range of 4–20 milliamps. Preferably, the present invention includes a means for adjusting the sensitivity of the flame detector, such as, for example, by varying the gain of the signal conditioning circuitry.

The present invention also provides a method for determining the existence of a flame in a gas turbine engine by: exposing a photodiode to the OH emission line of a hydrocarbon flame; generating a photocurrent that is proportional to the intensity of ultraviolet radiation contained in the flame; amplifying the photocurrent output by the photodiode; and determining the presence of a flame based on the photocurrent output by the photodiode. Preferably, the present invention includes a step of adjusting the sensitivity of the flame detector, such as, for example, by varying the gain of the signal conditioning circuitry.

BRIEF DESCRIPTION OF THE DRAWINGS

The present invention will be described in detail herein with reference to the following drawings in which like reference numerals refer to like elements, and wherein.

DETAILED DESCRIPTION OF EXEMPLARY EMBODIMENTS

The present invention is directed to a photodiode based flame detection system operating on a two wire current loop to detect the presence of flame in gas turbine engines. Both the power and signal are carried on a single pair of wires W1, W2. In a preferred exemplary embodiment, illustrated in FIG. 1, the photodiode D4 is preferably a silicon carbide photodiode, because silicon carbide photodiodes provide a spectral response that matches the OH emission line of a hydrocarbon flame, such as the flame found in gas turbine engines. Furthermore, silicon carbide photodiodes are capable of operating in high temperature environments where temperatures are regularly as high as 250° C. It will, of course, be understood that the invention is not limited to silicon carbide photodiodes. Any photodiode that provides a spectral response suitable for the detection of flames in a gas turbine engine and having the necessary heat resistance may be used.

Figure 1:
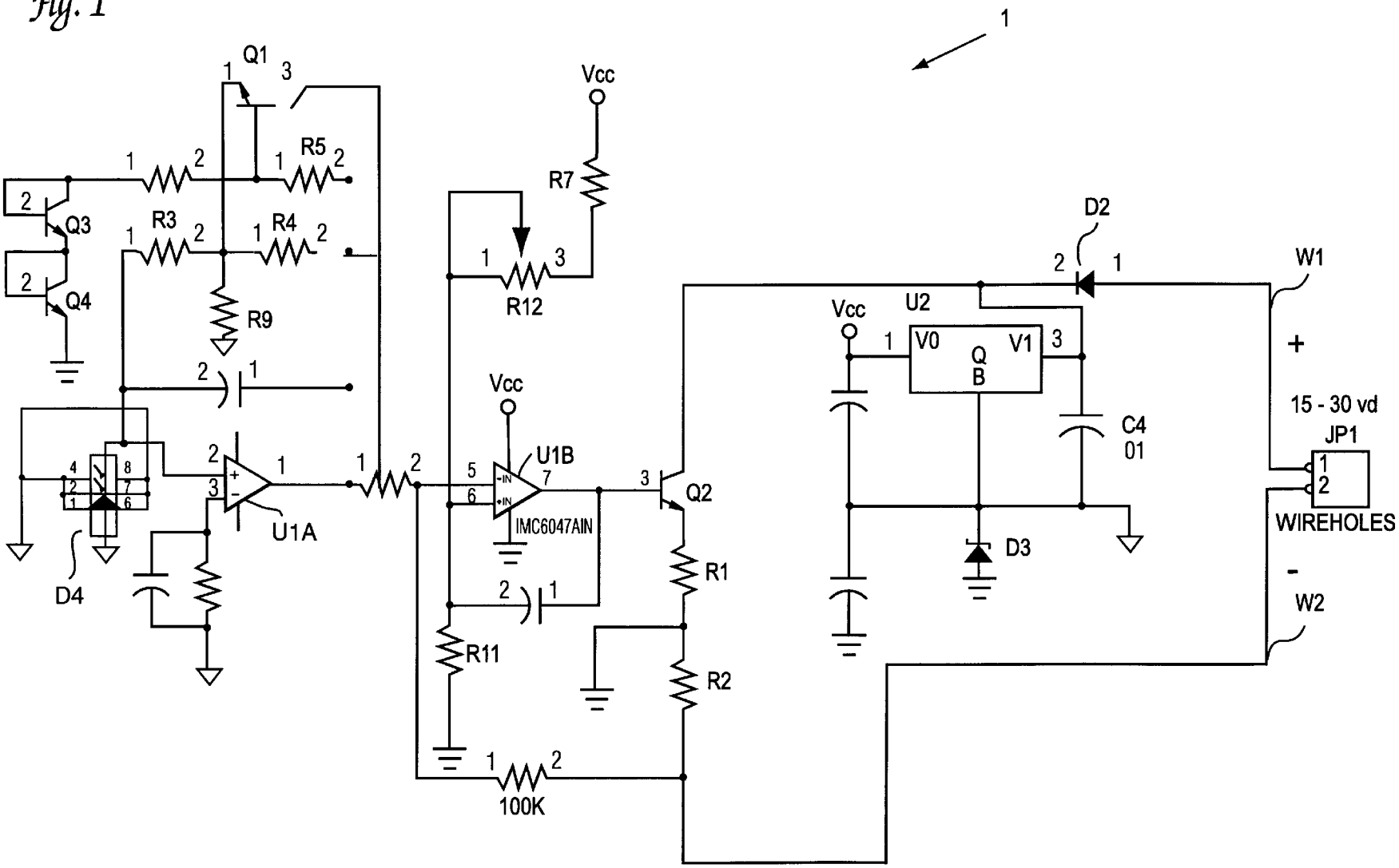
FIG. 1 is a schematic drawing of a preferred embodiment of the flame detector and signal conditioning circuitry of the present invention.

Turning now to FIG. 1 a schematic diagram of the flame detection circuit 1 according to a preferred exemplary embodiment of the present invention is shown. The photodiode D4 produces a photocurrent output signal that is proportional to the intensity of ultraviolet electromagnetic radiation to which it has been exposed. The output signal from the photodiode D4 is amplified and converted by current to voltage converter/amplifier U1A. The gain of amplifier U1A is determined by the feedback network comprising resistors R3, R4 and R9. Automatic gain control of the amplifier U1A is accomplished by shunting resistor R4 out of the circuit, thereby reducing the gain in proportion to the new feedback resistance (i.e., the feedback network without resistor R4), and reducing the amount of amplification of the signal output from the photodiode D4. Shunting of resistor R4 out of the feedback network occurs when the output of amplifier U1A increases to the point that transistor Q1 conducts. When Q1 conducts, resistor R4 is shunted out of the feedback network and gain is reduced by the new feedback network.

The output of amplifier U1A is connected to amplifier U1B which, in combination with transistor Q2 forms a voltage to current converter. Thus, the voltage output of U1A is converted to a current output. Transistor Q2 regulates the current in the loop such that it is proportional to the signal output by the amplifier U1A. The resistive network formed by resistors R7, R11 and R12 provides bias to set the zero current at the desired level. The power supply for the circuit 1 is provided by U2 and zener diode D3. Power supply current is passed through sense resistor R2 and is included in the loop current.

In an alternative exemplary embodiment, the breakpoint circuit formed by transistors Q1, Q3 and Q4 and resistors R5 and R10 may be eliminated. Eliminating the breakpoint circuit would eliminate the automatic gain change and provide a linear output throughout the entire range of operation.

Figure 2:
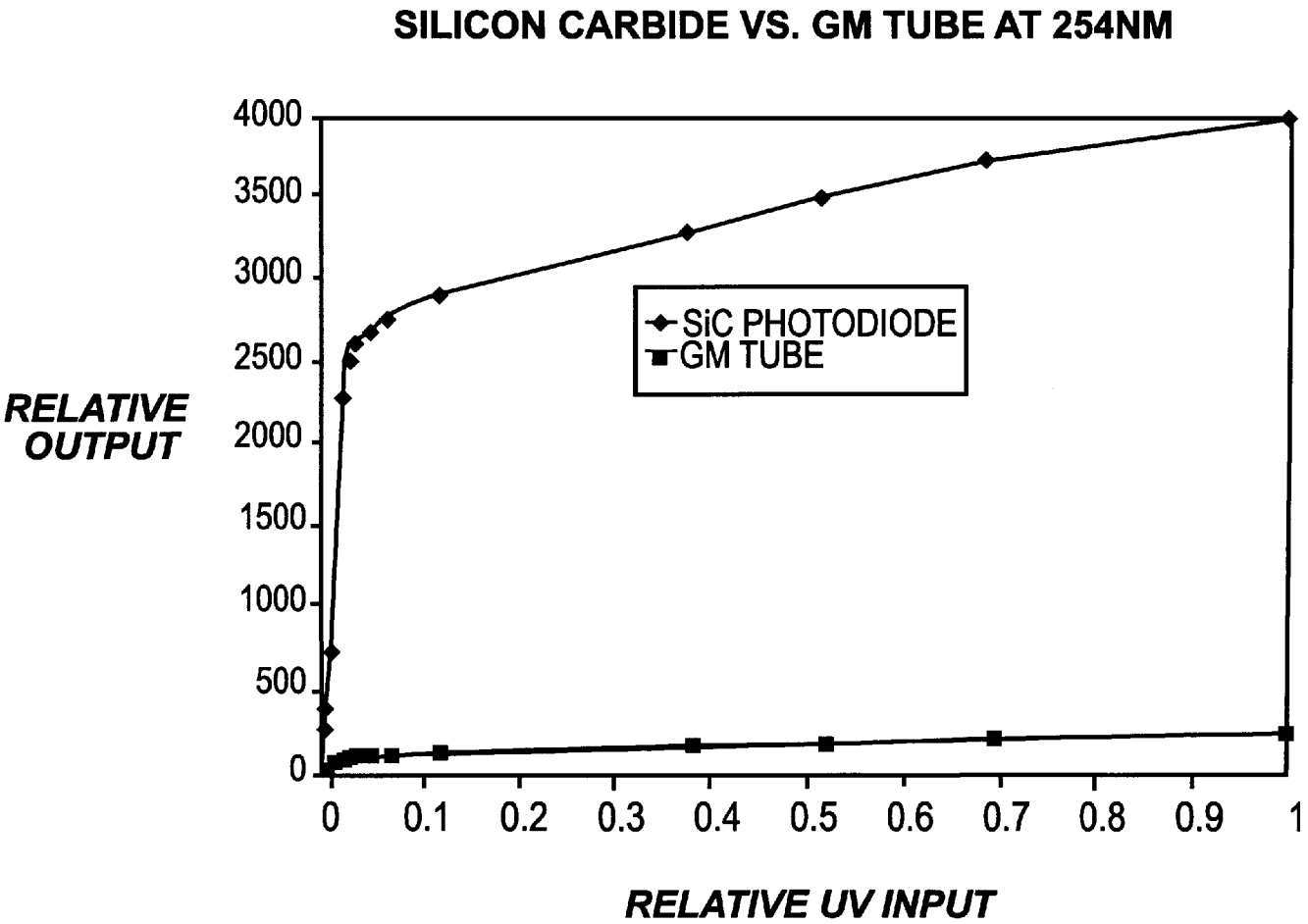
FIG. 2 is a graphical comparison of the output of a gas discharge tube versus a silicon carbide photodiode when exposed to ultraviolet radiation at 254 nm.
Figure 3:
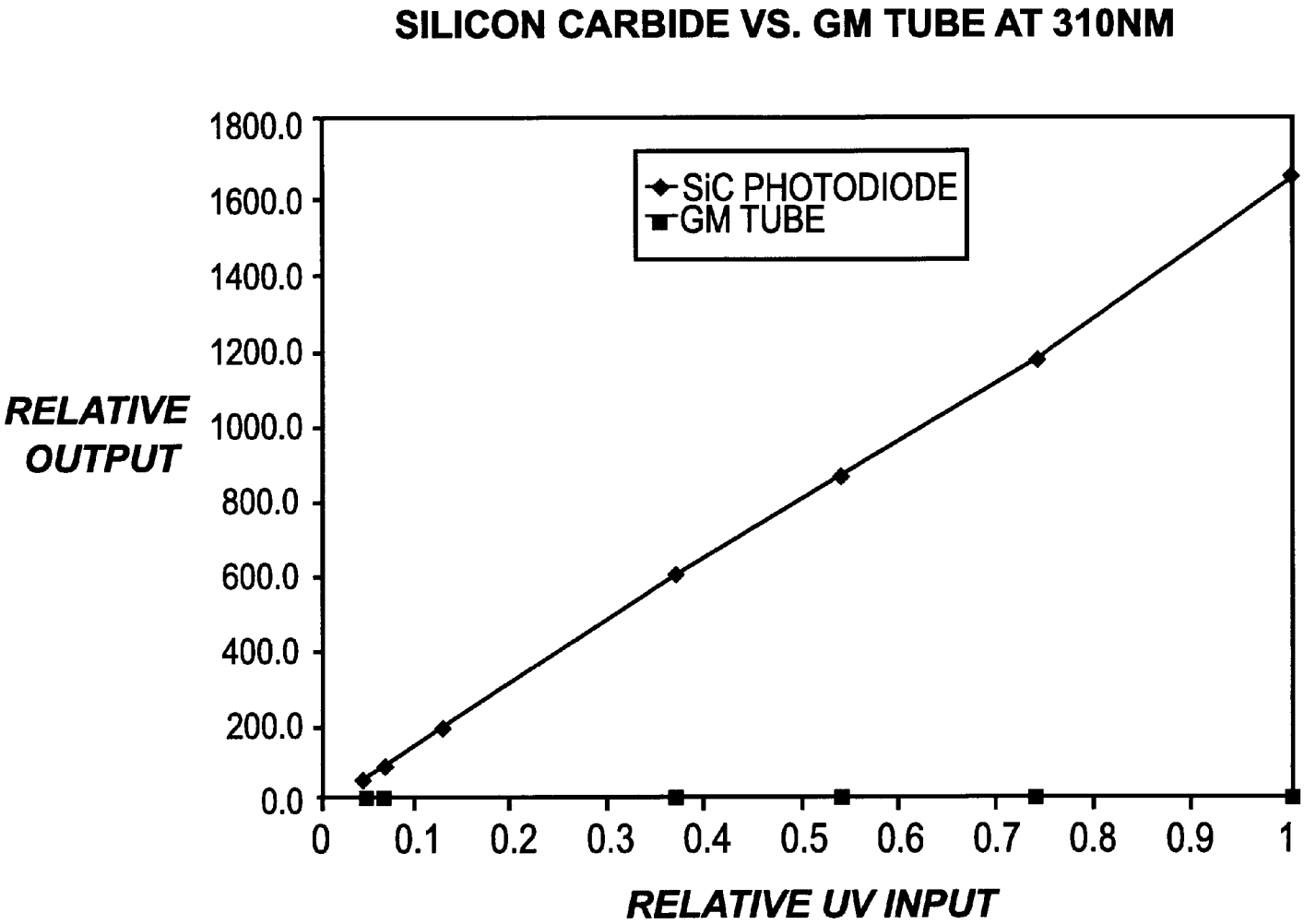
FIG. 3 is a graphical comparison of the output of a gas discharge tube versus a silicon carbide photodiode when exposed to ultraviolet radiation at 310 nm.

In operation, the flame detection circuit 1 of the present invention is placed, for example, in the OH emission line of a hydrocarbon flame of a gas turbine engine (not shown). It will be apparent to those of ordinary skill in the art that an appropriate housing and window for the detection circuit 1 is required to place it in operation, and that such housings and windows are known to those skilled in the art. Illustrative examples of gas turbine engines and sensor arrangements are shown in U.S. Pat. Nos. 5,303,684 and 5,093,576. Preferably, a silicon carbide photodiode having a peak response at 270 nanometers with a broad response curve that covers the 310 nanometer peak of the hydrocarbon flame, as shown in FIGS. 2 and 3, is used. A typical cutoff wavelength for silicon carbide photodiodes is about 400 nanometers.

Upon exposure of the photodiode D4 to the OH emission line, the photodiode D4 will produce a photocurrent proportional to the intensity of the ultraviolet radiation of the flame. If no flame is present, or the flame is unacceptably low, the photocurrent output by the photodiode D4 will be low or zero. Thus, a flame out condition will be detected. If a flame is present, the photocurrent output by the photodiode D4 is transmitted to a current to voltage converter/amplifier U1A. The amplifier U1A converts the photocurrent to a voltage. The gain of U1A is determined by the feedback network R3, R4, R9. The gain may be automatically controlled by the breakpoint circuit Q1, Q3, Q4, R10, R5, which acts to shunt resistor R4 out of the feedback loop when the output voltage of the amplifier U1A is high enough to cause Q1 to conduct.

The voltage output of U1A is then fed to voltage to current converter U1B, Q2. Q2 regulates the current in the loop such that it is proportional to the voltage output by U1A. The resistance levels of the resistor network R7, R1, R12 are selected to ensure that the amplified signal from the photodiode D4 is converted to an industry standard 4–20 milliamps. The sensitivity of the photodiode D4 may be controlled by the gain of the amplifier stage U1A. The sensitivity is increased by increasing the gain. In other words, a smaller output photocurrent may be used to detect the ultraviolet radiation. On the other hand, the sensitivity of the photodiode D4 is reduced by reducing the gain of the amplifier stage U1A. By reducing the gain, a larger output signal from the photodiode D4 is required for flame detection. As shown in FIG. 1, the gain is automatically reduced when the voltage output of the amplifier U1A is reaches a predetermined high level. This indicates that the photodiode D4 has enough sensitivity to operate with less gain. Thus, the sensitivity of the flame detector is reduced.

Turning now to FIGS. 2 and 3, the preferred photoresponse of the photodiode D4 is shown in comparison to a phototube, such as, for example, a Geiger-Mueller gas discharge tube. The photodiode has a spectral response that is broad and covers the 310 nanometer peak of the hydrocarbon flame. This is particularly important because absorption by injected steam, water or pre-mixed fuel is less at 310 nanometers than it is at 200 nanometers. It is also preferable to provide a photodiode that has a cutoff around about 400 nanometers, thereby rendering the photodiode "blind" to potential interfering blackbody radiation from the turbine walls.

The above described flame detection circuit 1 provides increased ultraviolet sensitivity that detects the presence of a flame through a mist of steam, water or pre-mixed fuel, and eliminates the need for high voltage operation. Additionally, the flame detection circuit of the present invention provides relatively fast response times, for example, in the range of about 25 milliseconds, thereby avoiding unnecessary turbine shutdown during mode changes.

While this invention has been described in conjunction with specific embodiments thereof, it is evident that many alternatives, modifications and variations will be apparent to those skilled in the art. Accordingly, the preferred embodiments of the invention, as set forth herein, are intended to be illustrative, not limiting. Various changes may be made without departing from the true spirit and full scope of the invention, as defined in the following claims.

What is claimed is:

1. A flame detection circuit for detecting the presence of a flame in a gas turbine engine, comprising:

a photodiode responsive to electromagnetic radiation from said flame, said photodiode generating a photocurrent proportional to an intensity of a predetermined portion of said electromagnetic radiation;

a current to voltage converter connected to said photodiode, said current to voltage converter converting said photocurrent to a voltage, said current to voltage converter being provided with a feedback loop for providing gain thereto;

a voltage to current converter connected to an output of said current to voltage converter, said voltage to current converter including a current regulator for maintaining an output of said voltage to current converter proportional to the voltage output by said current to voltage converter; and a resistive biasing network for setting a zero bias current of said circuit, wherein an output of said flame detection circuit is indicative of the presence of a flame.

2. The flame detection circuit of claim 1, further comprising an automatic gain control circuit connected to an output of said current to voltage converter, said automatic gain control circuit reducing a gain of said current to voltage converter when said output of said current to voltage converter exceeds a predetermined value.

3. The flame detection circuit of claim 1, wherein said photodiode comprises silicon carbide.

4. The flame detection circuit of claim 3, wherein said silicon carbide photodiode has a spectral response in the range of 190 to 400 nanometers.

5. A method for detecting the presence of a flame in a gas turbine engine, comprising the steps of:

placing a photosensitive diode in an OH emission line of said gas turbine engine;

generating a photocurrent proportional to electromagnetic radiation produced by a flame;

applying a predetermined gain to said photocurrent;

converting said photocurrent to a voltage signal;

converting said voltage signal to a regulated output current; and determining the presence of a flame based on said regulated output current.

6. The method according to claim 5, further comprising the step of:

automatically adjusting a gain of said current to voltage converter to adjust a sensitivity of said photosensitive diode.

7. The method according to claim 5, wherein said photosensitive diode comprises silicon carbide.

8. The method according to claim 7, wherein said silicon carbide photodiode has a spectral response in the range of 190 to 400 nanometers.

9. The method according to claim 6, further comprising shutting down the gas turbine engine upon the detection of a flame out condition.

* * * * *